United States Patent [19]

Gertsch

[11] Patent Number: 4,479,664

[45] Date of Patent: Oct. 30, 1984

[54] SKI SAFETY BINDING

[75] Inventor: Ullrich Gertsch, Matten, Switzerland

[73] Assignee: E. and U. Gertsch AG, Ski-Produkte, Interlaken, Switzerland

[21] Appl. No.: 320,532

[22] Filed: Nov. 12, 1981

Related U.S. Application Data

[63] Continuation of Ser. No. 47,701, Jun. 12, 1979, abandoned.

[30] Foreign Application Priority Data

Jun. 13, 1978 [DE] Fed. Rep. of Germany ..... 2825876

[51] Int. Cl.[3] ..... A63C 9/08

[52] U.S. Cl. ..... 280/618; 280/605; 280/629; 280/625

[58] Field of Search ..... 280/617, 618, 620, 625, 280/629, 635, 605

[56] References Cited

U.S. PATENT DOCUMENTS

| | | | |
|---|---|---|---|
| 3,079,163 | 2/1963 | De Beausacq | 280/616 |
| 3,145,027 | 8/1964 | Berchtold | 280/620 |
| 3,489,424 | 10/1967 | Gertsch | 280/618 |
| 3,647,235 | 3/1972 | Beyl | 280/618 |
| 3,764,155 | 10/1973 | Perryman | 280/618 |
| 3,930,661 | 6/1976 | Marker | 280/618 |
| 3,966,218 | 6/1976 | Beyl | 280/618 |
| 4,036,509 | 7/1977 | Schwarz | 280/605 |
| 4,061,357 | 12/1977 | Salomon | 280/605 |
| 4,113,276 | 9/1978 | Kirsch | 280/618 |
| 4,163,569 | 8/1979 | Horn | 280/618 |
| 4,314,714 | 2/1982 | Gertsch | 280/635 |

FOREIGN PATENT DOCUMENTS

| | | | |
|---|---|---|---|
| 330632 | 7/1974 | Austria | 280/618 |
| 1229429 | 11/1966 | Fed. Rep. of Germany | 280/635 |
| 2510385 | 2/1975 | Fed. Rep. of Germany | 280/635 |
| 2705215 | 1/1977 | Fed. Rep. of Germany | 280/618 |
| 1446991 | 9/1965 | France | 280/618 |
| 1534635 | 7/1968 | France | 280/629 |
| 571876 | 1/1976 | Switzerland | 280/618 |
| 953234 | 3/1964 | United Kingdom | 280/635 |

*Primary Examiner*—David M. Mitchell

*Attorney, Agent, or Firm*—Fleit, Jacobson, Cohn & Price

[57] ABSTRACT

A safety ski binding having a pivotal binding plate releasably held in a skiing position, includes separate holder elements on opposite sides of the plate. The holder elements prevent lateral movement of the boot relative to the plate until the plate has been pivoted beyond a predetermined angle. On exceeding the angle, the holder elements may pivot freely to allow lateral release of the boot.

6 Claims, 11 Drawing Figures

SKI SAFETY BINDING

This is a continuation of application Ser. No. 047,701 filed June 12, 1979 and now abandoned.

SUMMARY OF THE INVENTION

The invention relates to a ski safety binding with a release plate which is non-detachably fixed to the ski parallel to the ski plane by means of a pivot bearing, per se known automatic binding being provided for holding the skiing boot on the plate in the vicinity of the heel or toe of the boot.

BACKGROUND OF THE INVENTION

A ski safety binding of the type defined hereinbefore is known from Austrian Patent 330,632 in which case the plate can be swivelled to a limited extent on the ski in a pivot bearing in the ski plane, but in the vertical direction is non-detachably fitted to the ski. Furthermore, in the rear plate area of this ski there is a retaining member which cooperates with the automatic binding located at the end of the plate in such a way that the automatic heel binding releases the skiing boot in the case of a specific rotation of the plate. Finally, there is a third fastening on the ski in the front plate area and an elastic mounting support connected to said fastening.

The automatic heel binding differs from the known automatic heel bindings in that there is a shoulder in its lower area on which rests part of an anchoring device, which in turn cooperates by means of a cylinder and a pressure plate with the retaining member fitted to the ski.

The toe of the boot is held on the plate by means of a per se known bow-shaped retaining member. An important disadvantage of said known ski safety binding is its complicated construction and consequently its susceptibility to faults. In addition, at least three binding components have to be fixed to the ski. Due to the three-point fixing in the case of pronounced bending of the ski a jamming effect can occur, so that both the travel characteristics of the ski and the release conditions can be modified. In the case of the three-point fixing according to the Austrian Patent, assembly costs are high and there is a considerable risk of assembly errors. Finally, only a single automatic heel binding can be used with this known ski safety binding and it must be modified for its functional adaptation to the known ski binding.

Other similar binding systems are known, but these are even more remote from the subject matter of the invention. Thus, for example, DOS No. 2,510,385 discloses a ski binding in which a plate is arranged in rotatable, but non-detachable manner on the ski. In addition to the devices of the ski bindings referred to hereinbefore it has a device on the ski which holds the plate in the normal position. The bearing member which is also affixed to the ski controls by means of a rod-spring mechanism a mounting support for the toe of the boot located on the plate and movable in the longitudinal direction of the ski. The subject matter of this application also has the same disadvantages as described relative to Austrian Pat. No. 330,632.

Finally, French Pat. No. 1,446,991 discloses a binding in which the mounting support for the toe of the boot is provided by laterally arranged jaws which are detachably connected to the plate and by means of a bearing member on the ski are completely detached from the release plate by falling out sideways on pivoting the plate. It is inter alia extremely disadvantageous that special measures must be provided in order not to lose the lateral jaws which have been completely detached from the plate. The refitting of the jaws after the fall is relatively difficult and the release mechanism opened by the fall can become filled with snow and dirt.

The object of the present invention is to obviate the disadvantages of the prior art and provide a ski safety binding which combines the recognized examples of the plate binding and those of automatic bindings, particularly automatic heel bindings, whilst simultaneously overcoming the disadvantages of the plate binding resulting from the complete detachment of the plate from the ski. In addition, the intention is to provide a binding in which the detachable mounting supports for the skiing boot form an integral part of the plate and remain such part in all operating positions. A further object is to provide such an integral binding system in which per se known ski brakes are operationally adapted in such a way that, unlike in the case of a conventional plate binding, the ski boot is arranged in the normal position of the plate before entering the braking position and not in the rest position.

These objects, as well as others, are achieved by the novel ski safety binding according to the present invention.

A decisive advantage of the ski safety binding according to the invention is that the binding essentially comprises only two components, namely the plate mounted in rotary, but non-detachable manner on the ski with the safety mounting support for the boot and the ski brake optionally integrated into the plate, and a device fixed to the ski for the simultaneous regulation of the turning angle and the turning force of the plate. There is no need to have other devices stuck or screwed to this ski. A further important advantage is provided by the possibility of using in unchanged form per se known automatic bindings on the plate, either in the heel area of the boot or in the toe area thereof. Another important advantage is that due to the association and cooperation of the device for transmitting and regulating the turning force of the plate which is fitted to the ski with a correspondingly constructed end portion of the plate, but only is it possible to establish the maximum plate turning angle which cannot be exceeded, but at the same time the force necessary for exceeding the minimum angle of plate rotation on the ski is transmitted and regulated and the blocking plate portions are released. Finally the plate end which cooperates with the device for transmitting and regulating the plate turning force can be constructed in such a way that not only is the horizontal rotation of the plate regulated and limited, but in the same way the vertical rotation and this can optionally be made possible and aided by the fact that the central area of the plate is constructed so as to vertically pivot about an axis or about an elastic soft region acting as an axis. The fact that the device for transmitting and regulating the turning force fulfils various functions is a reason why the apparatus according to the invention is very simple as regards construction and assembly but functions in an optimum manner as a ski safety binding.

A further advantage of the ski binding according to the invention is the short distance between the two members fixed to the ski. This leads to a minimum longitudinal bracing of the ski and minimum influencing of the release functions of the binding in the case of bending of the ski. Another advantage is that there is much less chance of assembly errors and the assembly time is greatly reduced. It has also proved advantageous that the pivot point of the sideways release (twisting fall) is located in the lengthened leg axis. This leads to optimum protection against injury in the case of a twisting fall, as well as optimum protection against false releases (the central disk absorbs direct lateral short and therefore harmless skiing impacts).

DRAWINGS

The invention is described hereinafter relative to the drawings, wherein show:

FIG. 1 a side view of a binding according to the invention.

FIG. 2 a plan view of the construction according to FIG. 1.

FIG. 3 the plan view of the binding of FIG. 2 with an integrated ski brake.

FIG. 4 a side view of another binding construction according to the invention.

FIG. 5 a plan view of a modification of the construction according to FIG. 4.

FIG. 6 a side view of a further embodiment according to the invention.

FIG. 7 a plan view of the embodiment of FIG. 6.

FIG. 8 a side view of another binding construction according to the invention.

FIG. 9 a plan view of the construction according to FIG. 8.

FIG. 10 a side view of the ski binding construction of FIGS. 8 and 9 in the release position.

FIG. 11 a plan view of a ski binding part according to the invention with vertical swivel axis of the blocking plate part.

DETAILED DESCRIPTION OF PREFERRED EMBODIMENT

Figure 1:
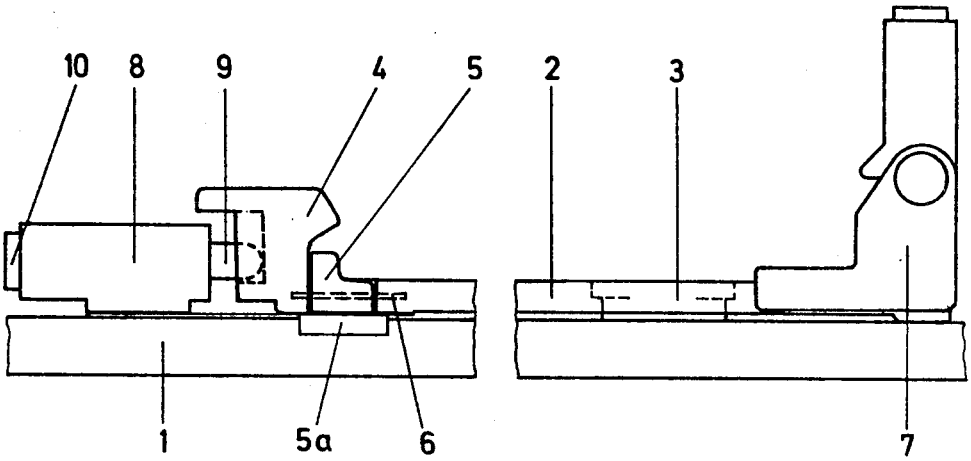

FIG. 1 shows a side view of a binding construction according to the invention in which 1 is the ski and 2 the binding plate. The binding plate 2 is fixed to ski 1 solely by the pivot bearing 3 which is attached or screwed to the ski, said pivot bearing in the form of a central disk preferably being arranged on the ski in the extended leg axis. Binding plate 2 pivots about pivot bearing 3 in a plane parallel to the surface of the ski. In the front and rear areas the plate can rest freely on the ski and the particular ski surface can optionally be protected by a metal part (steel or plastic) 5*a* against scratching and the like, the edges of this sheet-like part 5*a* being bent downwards over the edges of the ski, and preferably being constructed of two connected pieces to be adjustable to the width of the ski. In the present embodiment, a mounting support 4 is arranged in the boot toe area for the toe of the boot and/or the projecting sole of the boot. 5 is a pivotable plate part laterally arranged on the plate and which prevents sideway slipping out of the skiing boot when the plate is in the normal position. The pivotable plate part 5 is pivotable about pin 6 arranged in the marginal area of the plate approximately in the longitudinal direction of the ski. In the front part of mounting support 4 there is a control profile which is in engagement with a plunger 9 of a spring plunger device 8, such as a device of the type described in U.S. Pat. No. 3,489,424. Such device is provided for transmitting and regulating the force to be applied for controlling the rotation of the plate and the maximum rotation angle of the plate on the ski. The force transmitted to the plate by device 8 and which thus acts counter to the rotation of the plate out of the normal position is regulatable in per se known manner by an adjusting screw 10. In case of a twisting or torsional fall of the skier, binding plate 2 is pivoted out of the normal skiing position against the force of the spring acting plunger 9. After binding plate 2 has rotated through a predetermined angle, pivotable plate art 5 is released and rotated about its axis. This results in a release of the shoe. At this predetermined angle of rotation, plunger 9 still acts together with the control profile in the front part of the mounting support 4. After the shoe has been released, no further torsional moment acts on plate 2. Under the action of spring-biased plunger 9 still cooperating with the control profile, plate 2 is automatically returned back to its normal skiing position. Binding plate 2 rotates therefore only as far as it is necessary to release the ski-boot. A per se known automatic heel binding 7 which releases the heel of the boot in the case of a frontal fall is positioned in the shoulder area of the plate. This automatic heel binding is adjustable in per se known manner in the longitudinal direction of the plate; preferably on a sledge or support slide gliding in or on the plate, also, preferably a ski brake (12, 14) of the type shown in FIG. 3, may be mounted within the sledge, the stirrup 12 being always in the same position under the heel of the ski boot and relative to heel binding 7.

If a torsional force acts on the plate, via the ski boot held therein, in the direction of the outer edge of the ski, plate 2 rotates about the central disk 3 counter to the restoring force of device 8. If this rotation exceeds a minimum value, which is on the one hand a function of the acting force and on the other the geometrical dimension of the contact surface of plate part 5 on the ski, over and beyond the corresponding edge of the ski the swivelling of plate part 5 about pin 6 is permitted and the boot can slide laterally out of the plate.

Figure 2:
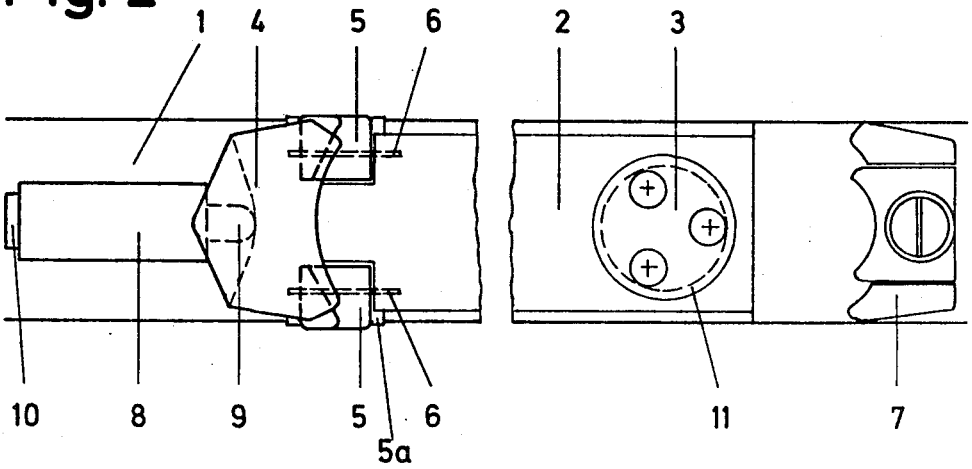

FIG. 2 is a plan view of the previously described binding system, the reference numerals designating the same components. 11 is a circular collar in the opening in the ski plate on which rests the marginal area of the, for example mushroom-shaped central disk 3, so that in the vertical direction the plate is fixedly connected to the ski and in the horizontal direction is rotatably connected thereto. Operation in the case of torsional loading is identical with that described relative to FIG. 1.

Figure 3:
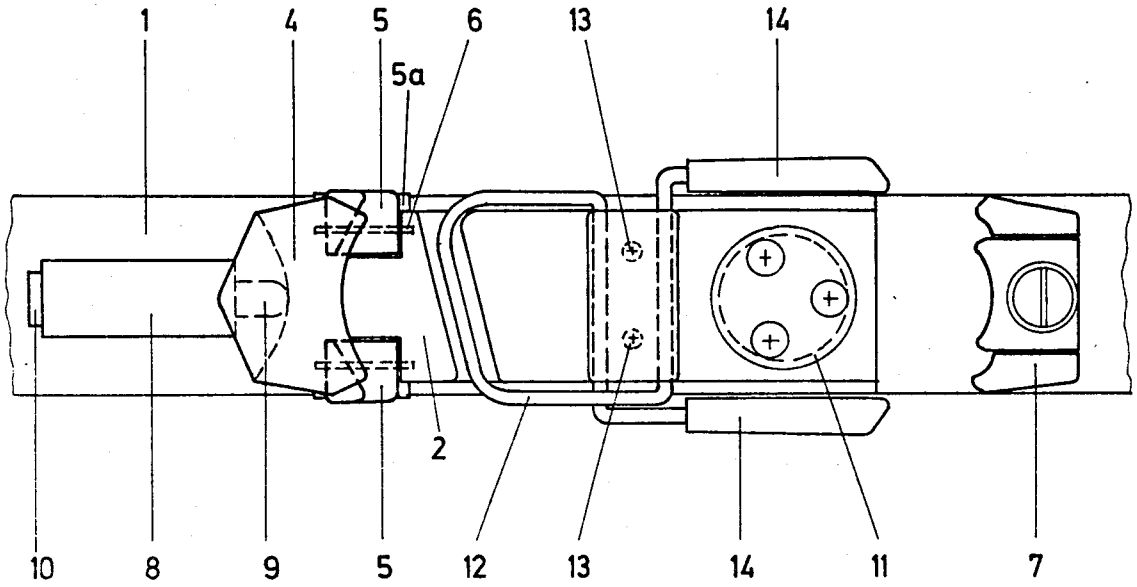

In FIG. 3, the above-described binding is additionally provided with a per se known ski brake. The ski brake is passed through two bores extending approximately centrally through the plate parallel to the transverse axis of the ski, so that in the locked position the stirrup 12 is held between the sole of the skiing boot and the plate and the brake rings 14 are held in the horizontal position alongside the plate. Advantageously a depression for said stirrup is provided on the plate in the vicinity of the stirrup portion crossing the same. For repair and assembly purposes, it can also be advantageous to make bores and screws 13 accessible enough through a cover which can be screwed to the plate for the fitting or replacement of the binding.

Figure 4:
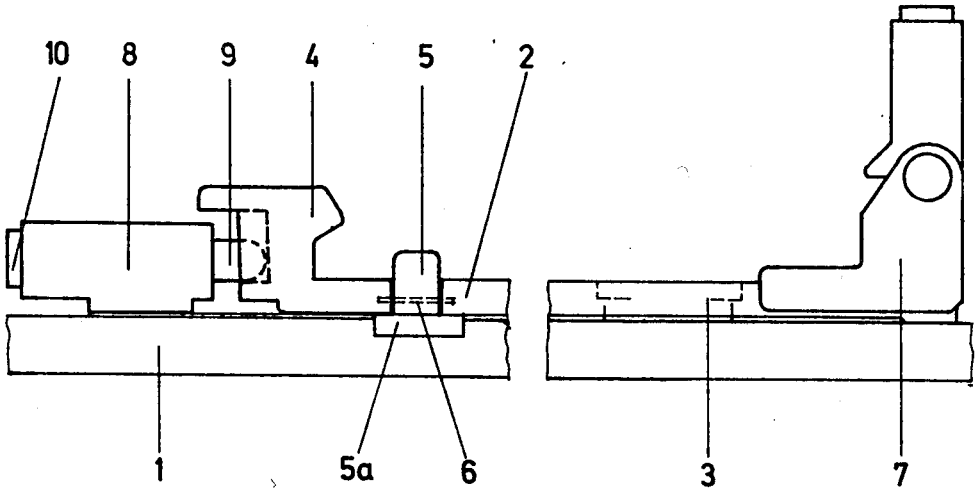
Figure 5:
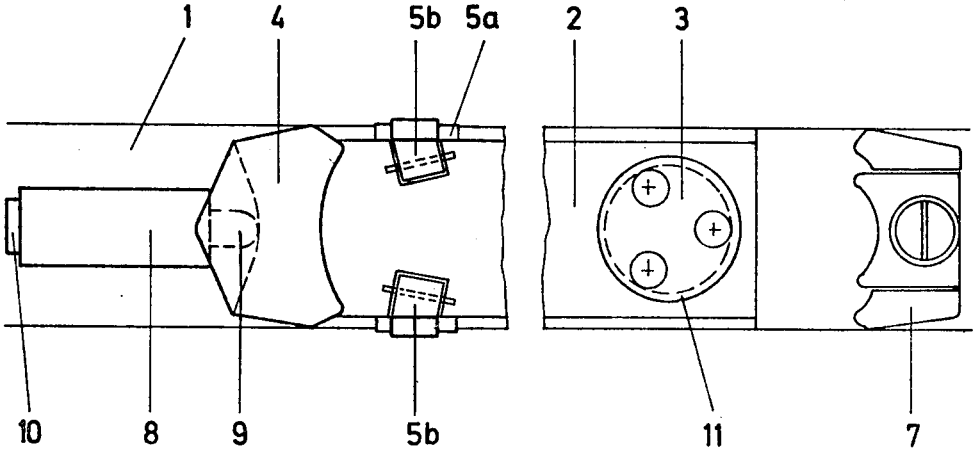

FIGS. 4 and 5 show further embodiments of the ski binding according to the invention, which differ from those described relative to the preceding drawings solely through the pivotable plate parts 5 being arranged in the ball area of the skiing boot and not in the vicinity of the toe of the boot. Otherwise, the construction and operation is the same as for the previously described embodiment. In this connection, it is expressly pointed out that in FIG. 5 the plate parts 5*b* and the pivot pins are preferably arranged in such a way that in the normal position of the plate the pins form an angle with the longitudinal axis of the ski which is identical with the above-mentioned minimum angle for the rotation of the plate, so that on rotation about this minimum angle the pin is positioned parallel to the particular edge of the ski.

Figure 6:
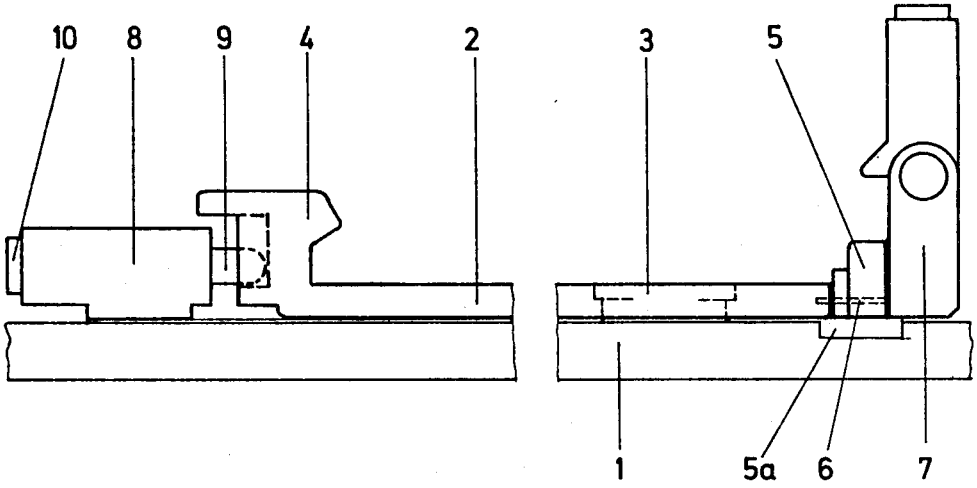
Figure 7:
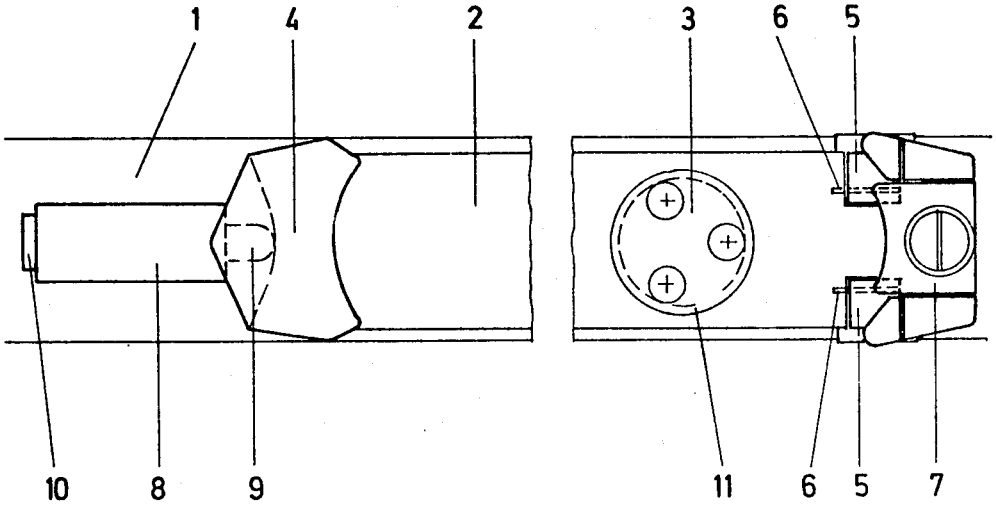

The embodiment of FIGS. 6 and 7 differs from that described hereinbefore particularly due to the fact that the pivotable plate parts 5 are arranged on the plate in the heel area of the skiing boot. This embodiment can be combined with per se known automatic binding both in the heel area and in the toe area of the boot. However, it can be completely adequate to fix the toe of the boot on the plate with a device not having a release mechanism.

Figure 8:
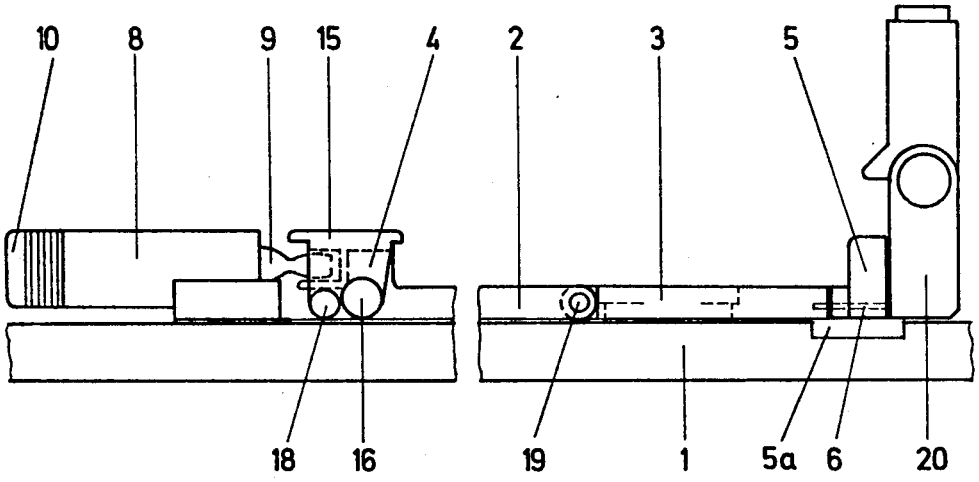

FIG. 8 diagrammatically shows a ski binding in which the skiing boot is released both in the case of a dorsal fall and in the case of a twisting fall due to the construction of the plate according to the invention. In the case of a frontal fall, the skiing boot is released by a per se known automatic heel binding which merely controls a vertical release. Ski 1 and plate 2 are interconnected in the described manner. The device 8 for transmitting the adjusting force and the maximum turning angle of the plate has a plunger 9 which is under strong spring pressure in both the horizontal and vertical positions. A mounting bearing for the front part of component 9 is provided on the front portion of support 4 of the plate and is fixedly connected thereto, but can pivot in both the vertical and horizontal directions. On the front portion of plate 2 and bridging the latter is provided a bridge-like component 15 about a pin 16 which is parallel to the transverse axis of the ski. Pin 16 is the hinge pin for component 15. Component 15 is in contact with the surface of the ski by means of a roller 18 which, constructed in one or more parts can be pivoted about an axis parallel to pin 16. The toe of the boot is placed under the upper end of component 15 which projects over the plate 2 and support 4, so that in this area, component 15 is correspondingly constructed and has lateral jaws to prevent the toe of the boot sliding out of this mounting support. The plate preferably has a hinge pin 19 extending parallel to the transverse axis of the ski, about which the plate part carrying component 15 is pivotable. In another embodiment, the plate is made elastic in this area, either by making the material thinner to the extent that this area is in the form of a flat spring, or by a corresponding selection of material in this area (plastics), so that a pivot pin in accordance with the drawing is superfluous.

The pivotable plate portions 5 according to the invention for releasing the skiing boot in the case of a twisting fall are in this embodiment located in the heel area of the binding. The skiing boot is released in the heel area by a per se known automatic heel binding 20 which releases only in the vertical direction.

Figure 9:
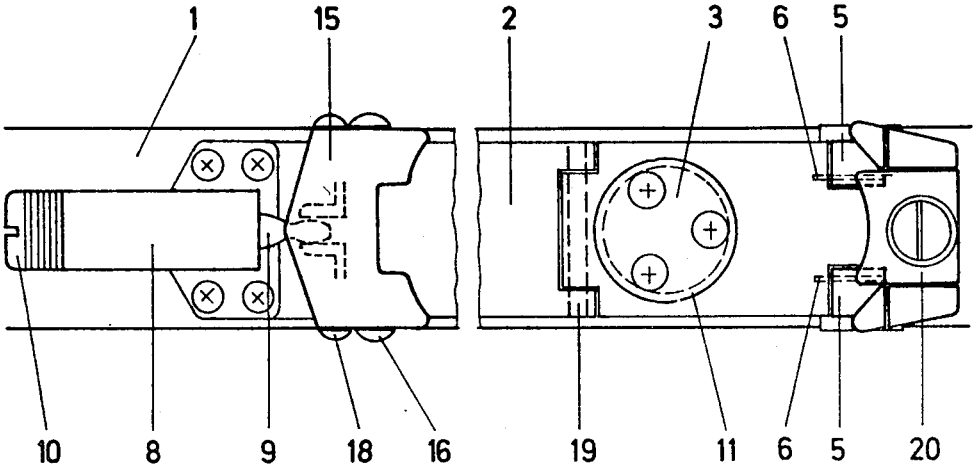

In another variant of this embodiment according to FIGS. 8 and 9, device 8 has a plunger which is resiliently mounted only in the longitudinal direction of the ski. To regulate the rotation of the plate 2 about rotary disk 3 and the vertical pivoting of the front plate part about pin 19, the front face 4 of the front plate part has a corresponding areal control profile.

In another variant of the embodiment of FIGS. 8 and 9 the pivotable plate parts 5 are located in the front area of ski plate 2 and are more particularly constructed in one piece with component 15.

Finally, the dorsal fall security system can be analogously used in the heel area as a frontal fall security system. The various other combinations of the fall security systems according to the invention with per se known automatic systems can easily be gathered from what has been stated hereinbefore by any Expert and need not therefore be enumerated in detail.

FIG. 9 is a plan view of the embodiment of FIG. 8, the same reference numerals being used.

Figure 10:
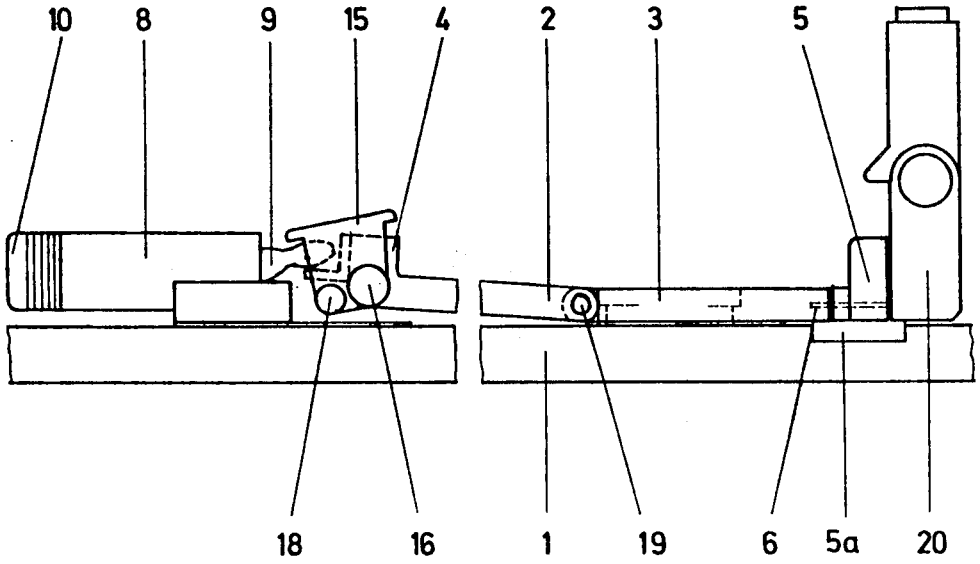

Whilst using the same reference numerals in FIG. 10 as in FIGS. 8 and 9, the figure diagrammatically shows an inventive construction according to FIGS. 8 and 9 in the position where the skiing boot is released. In this position the front part of plate 2 is vertically pivoted about pin 19 at an angle which is limited by the functional adaptation of component 9 to the front part of plate 2. The bow-shaped component 15 rollingly pivots by means of roller 18 on the surface of the ski about pin 16, so that the toe of the skiing boot, not shown on the ski plate, is released.

Figure 11:
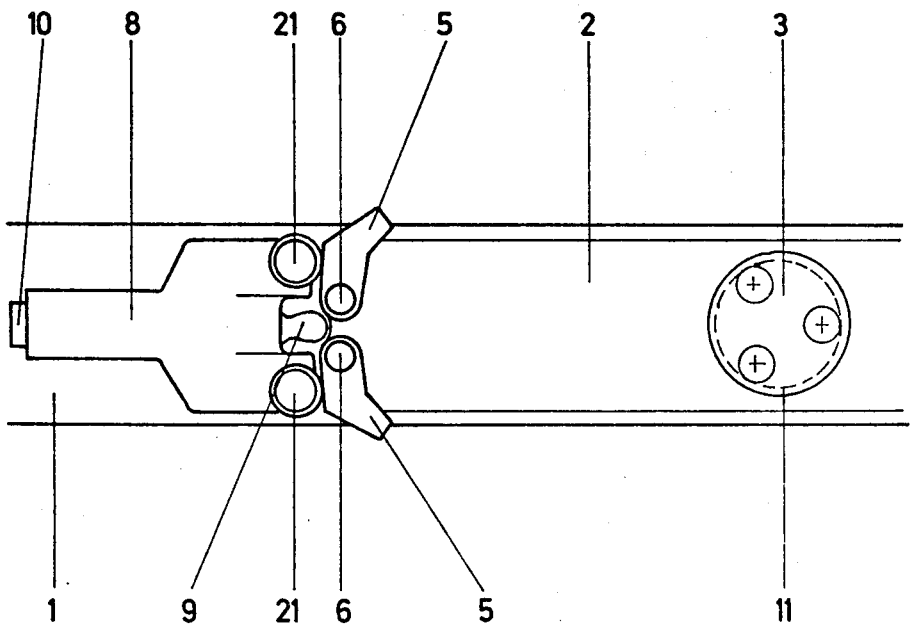

FIG. 11 diagrammatically shows how the pivotable plate parts 5 are pivoted about a vertically arranged pin 6. The pivotal plate parts 5 arranged about these axes cooperate with two abutments 21 located in the area of the ski edges in such a way that on rotating plate 2 beyond a minimum angle the plate parts 5 are pivoted about the vertical pins 6 in such a way that they release the previously locked boot.

I claim:

1. A safety ski binding comprising:

a binding plate for supporting the sole of a ski boot;

pivot bearing means for non-detachable fixing of said binding plate to a ski with an upper surface of said binding plate parallel to an upper surface of the ski, said binding plate being rotatable about said pivot bearing means between a normal skiing position and a laterally pivoted position in the event of a torsional fall of the skier, means for releasably holding said binding plate in said normal skiing position;

first binding means for holding the heel of the ski boot mounted on said binding plate at the rear end of said binding plate;

second binding means for holding the sole of the ski boot mounted on said binding plate at the forward end of said binding plate;

one of said first and second binding means comprising two separate holder elements for holding the ski boot at opposite sides of the lengthwise axis of the binding plate, each of said holder elements being mounted on the binding plate for rotation about an axis extending substantially perpendicular to the upper surface of the binding plate; and means for locking each holder element in a holding position, when the binding plate is in its normal skiing position and for releasing the respective holder element for rotation when said binding plate has rotated laterally out of its normal skiing position beyond a predetermined minimum angle.

2. A safety ski binding according to claim 1, wherein each holder element is mounted for rotation on a pivot pin extending upwards from the upper surface of said binding plate.

3. A safety ski binding according to claim 1, wherein said locking means comprise abutment means mounted on the ski.

4. A safety ski binding according to claim 1, wherein said second binding means comprise said holder elements.

5. A safety ski binding according to claim 1, further comprising ski brake means carried by said binding plate, the ski brake means being movable from a braking position into a rest position by movement of a portion of the ski brake means towards said binding plate.

6. A safety ski binding according to claim 5, wherein the ski brake means is a torsion ski brake having a stirrup, wherein the binding plate has holes formed therein extending parallel to the tranverse axis of the ski for receiving ends of said ski brake, and wherein the top of the binding plate has a recess for receiving the ski stirrup of the brake means, said stirrup being movable by the ski boot from a position above the binding plate onto the binding plate surface thereby moving the ski brake means into a retracted position.

* * * * *